US005985000A

United States Patent [19]

Shinohara et al.

[11] Patent Number: 5,985,000

[45] Date of Patent: Nov. 16, 1999

[54] METHOD FOR MANUFACTURING ELECTRODE MATERIAL FOR VACUUM CIRCUIT BREAKER

[75] Inventors: Hisaji Shinohara; Katsuro Shiozaki; Kazuro Shibata; Masayuki Furusawa; Shunichi Hatakeyama, all of Saitama; Hiromi Iwai, Chiba; Tatsuo Take; Tsuneki Shinokura, both of Mie, all of Japan

[73] Assignee: Fuji Electric Co., Ltd., Kawasaki, Japan

[21] Appl. No.: 09/044,948

[22] Filed: Mar. 20, 1998

[30] Foreign Application Priority Data

Mar. 24, 1997 [JP] Japan ..... 9-088817

[51] Int. Cl.[6] ..... C22B 9/00; C22B 34/30; C22C 27/06; C22C 1/00

[52] U.S. Cl. ..... 75/587; 75/623; 420/428; 420/590

[58] Field of Search ..... 420/495, 428, 420/590; 75/587, 623

[56] References Cited

U.S. PATENT DOCUMENTS

| | | | |
|---|---|---|---|
| 4,537,745 | 8/1985 | Hassler et al. | 420/428 |
| 5,480,472 | 1/1996 | Noda et al. | 420/590 |
| 5,636,241 | 6/1997 | Yamada et al. | 373/156 |

*Primary Examiner*—Prince Willis
*Assistant Examiner*—Tima McGuthry-Banks
*Attorney, Agent, or Firm*—Kanesaka & Takeuchi

[57] ABSTRACT

To provide a Cu-Cr alloy electrode material, a mixture of Cu and cr materials at a predetermined ratio is heated until the mixture has been entirely melted, and the molten metal obtained is quenched to precipitate fine Cr particles in a Cu base. Since Cr is melted into Cu before quenching, and then Cr precipitates, Cr particles finer than those in the sintering or infiltration method can disperse in a Cu base. This invention prevents defects such as voids in the structure and the weakening of the fusion of Cu and Cr or failure of Cr to precipitate into the Cu base caused by oxide films on the surface of the Cr particles, thereby providing a fine alloy structure.

7 Claims, 2 Drawing Sheets

METHOD FOR MANUFACTURING ELECTRODE MATERIAL FOR VACUUM CIRCUIT BREAKER

BACKGROUND OF THE INVENTION AND RELATED ART STATEMENT

The present invention relates to a method for manufacturing a Cu alloy used for an electrode material for a vacuum circuit breaker.

As well known, a vacuum circuit breaker turns an electric current on and off by using movable and fixed electrodes disposed in a vacuum container. The material of these electrodes must provide (1) a large breaking current, (2) a small chopping current, (3) a high dielectric breakdown voltage between electrodes, (4) a difficulty in welding; and (5) only a small amount of heat during current carrying. A large number of alloys have been researched and developed for such electrode materials, and melting and casting of alloys such as Cu-Bi (bismuth) and Cu-Te (tellurium), or sintering alloys such as Cu-W (tungsten) and Cu-Mo (molybdenum) have been used practically. Currently, a Cu-Cr alloy containing 20 to 70 wt % of Cr (chromium) is commonly used as a material that has all the properties listed above. In addition, these properties required of the electrode material for vacuum circuit breakers are affected not only by the metal components but also by contained gas, such as oxygen or impurities, or the fine uniformity of the metallic structure, so that the ingredients or materials must be very pure and be melted or sintered in a protective gas such as hydrogen or argon, or in a vacuum condition.

Cr is not substantially melted into Cu at a temperature near the melting point of Cu (approx. 1,083° C.). Conventional Cu-Cr alloys are made by powder metallurgy that uses Cr powders as a main material. For example, such alloys are manufactured by a sintering method that molds and sinters a mixture of Cu and Cr powders, or a melting-infiltrating method wherein a mixture of Cr powders and a small amount of Cu powders are molded and sintered to obtain a porous body, to which molten Cu is impregnated. In this case, the Cu-Cr alloy manufactured by using these methods includes Cr particles dispersed in the Cu base, but most of the dispersed Cr particles are almost as large as the ingredient powders. And only a small amount of fine Cr particles is contained in the alloy, which is formed such that Cr melts into Cu during heating and precipitates into Cu during cooling.

The conventional Cu-Cr alloy manufacturing method uses as materials Cr powders, which are formed such that Cr masses produced by Alumit process or electrolytic method are ground mechanically. As well known, Cr is easily oxidized, so that the surfaces of the Cr powders are covered with strong oxide films during grinding. In addition, the Cr powders are mixed with Cu powders by using a ball mill or a V mixer, and the Cr powders are oxidized even during this operation. The oxide film is thermally stable and can not be decomposed or reduced at a normal sintering temperature. Thus, the Cu-Cr alloy obtained by the powder metallurgy disadvantageously contains a large amount of oxygen. In the sintering method, the oxide film hampers the fusion of Cu and Cr, while in the melting-infiltrating method, it prevents Cu particles from infiltrating into the porous body, causing defects such as voids in the structure. These defects may reduce the breaking current or dielectric breakdown voltage.

Furthermore, in the conventional Cu-Cr alloy manufacturing method, the size of the Cr particles is determined by the size of ingredient powders. The reduction of the size of the Cr powders, however, is limited due to manufacturing techniques, and the fine Cr powders have increased surface areas, resulting in the correspondingly increased amount of oxygen contained therein. Thus, the conventional Cu-Cr alloy is unlikely to have fine Cr powders in a Cu base and its average particle size is limited to approx. 150 $\mu$m. The size of the Cr particles particularly affects the chopping current, which disadvantageously increases with the increasing of the size of the dispersed Cr particles. The uniformity of the dispersion of the Cr powders also affects the chopping current, and the value of the chopping current fluctuates when the dispersion is not uniform. If, however, the time required for mixture by using a ball mill is extended in order to ensure uniform dispersion, the oxidization of the ingredient powders is facilitated correspondingly.

As a method that solves the problems related to the sintering or the melting-infiltrating methods, Japanese Patent Application Laid Open No. 4-71970 discloses a method that uses an arc or laser for melting.

This method mixes, for example, Cr and Cu powders together, compresses, molds, and sinters the mixture to manufacture a columnar block; uses this block as an arc electrode to melt it gradually from one end by using an arc heat, and then sequentially solidifies it in a water-cooled mold. Other than the arc, the use of a laser or high-frequency plasma has been disclosed. This method can provide an alloy with uniformly dispersed fine Cr particles. Due to the use of the Cr powders, however, this method fails to satisfy the need to reduce the content of oxygen. Since this is a sequential melting and solidifying method that gradually melts the block from one end, the Cr and Cu powders must be as fine as possible and be uniformly mixed throughout the block in order to obtain a Cr-Cu alloy containing predetermined components throughout the casting mass. Thus, this method can not avoid the use of the powder materials and a mixing process that may increase the amount of oxygen.

In addition, the Cr-Cu alloy may contain Te, Bi, Sb, or Zn to improve resistance to the welding or to reduce the chopping current. Since these elements have a high vapor pressure, the temperature during melting must not be unnecessarily increased in order to avoid evaporation losses. Even if the alloy consists of only Cr and Cu, it is not preferable to unnecessarily increase the melting temperature, as evaporated Cu or Cr contaminates a melting furnace. Melting with an arc or laser necessarily increases the temperature up to several thousand degrees (Celsius), so that the temperature can not be controlled easily.

It is an object of this invention to manufacture a Cu-Cr alloy electrode material for a vacuum circuit breaker that has a low oxygen content and few defects in the metallographic structure, and in which fine Cr particles are uniformly dispersed in a Cu base.

SUMMARY OF THE INVENTION

In the invention, Cu and Cr materials are mixed at a predetermined ratio, and the mixed (material) is heated until they have been completely melted in order to obtain a molten metal with both elements melted uniformly. Then, the molten metal is quenched to precipitate a small amount of Cr in a Cu base in order to provide an electrode material for a vacuum circuit breaker. This invention does not require the use of Cr powders or the uniform mixture of Cr and Cu prior to melting. According to this manufacturing method, in the heating process, the Cr and Cu materials are fused to form a molten metal of uniform components, and then in the cooling process, Cr precipitates with Cu as fine spheres or branches. Since Cr is melted with Cu and then precipitated by cooling, the size of the Cr particle does not depend on the size of the ingredient of the Cr material and can be reduced down to a desired level by increasing the cooling speed. In addition, this invention can prevent the fusion of Cu and Cr from being weakened due to surface oxide films and also prevent the metallographic structure from becoming defective due to the failure of Cr to precipitate into the Cu base.

In the case of a Cu alloy containing 20 to 70 wt % of Cr, the heating temperature required to melt the Cu and Cr materials to obtain a uniform molten metal is between 1,800 and 2,000° C. This temperature, however, may be increased to 2,500° C. if the Cr content is large. If the material is heated at such a high temperature, Cu evaporates significantly and a crucible may be contaminated with the molten metal. To prevent this, the heating of the material is completed as quickly as possible to reduce the time during which it contacts the crucible. A more preferable alternative is a floating melting method (levitating method) that can be used to heat the material in such a way that it does not contact the crucible.

In addition, a high-frequency heating is preferably carried out to enable the temperature to be controlled by adjusting the output and to enable electromagnetic agitation. The electromagnetic agitation is expected to improve the uniformity of the components in the molten metal and to eliminate foreign materials such as ceramics that may enter the molten metal from the crucible.

The mixed Cu and Cr materials are ideally shaped like powders or masses. To reduce the content of oxygen, the Cr material preferably has an increased particle size and a reduced general surface area. The ideal particle size is 1 mm or more. Since the cooling speed affects the size of the precipitated Cr particles, quenching is required to obtain a fine organization or structure, but the particle size can be reduced down to about 20 to 30 $\mu$m by casting the molten metal into a water-cooled copper mold, as described below.

DETAILED DESCRIPTION OF A PREFERRED EMBODIMENT

Figure 3:
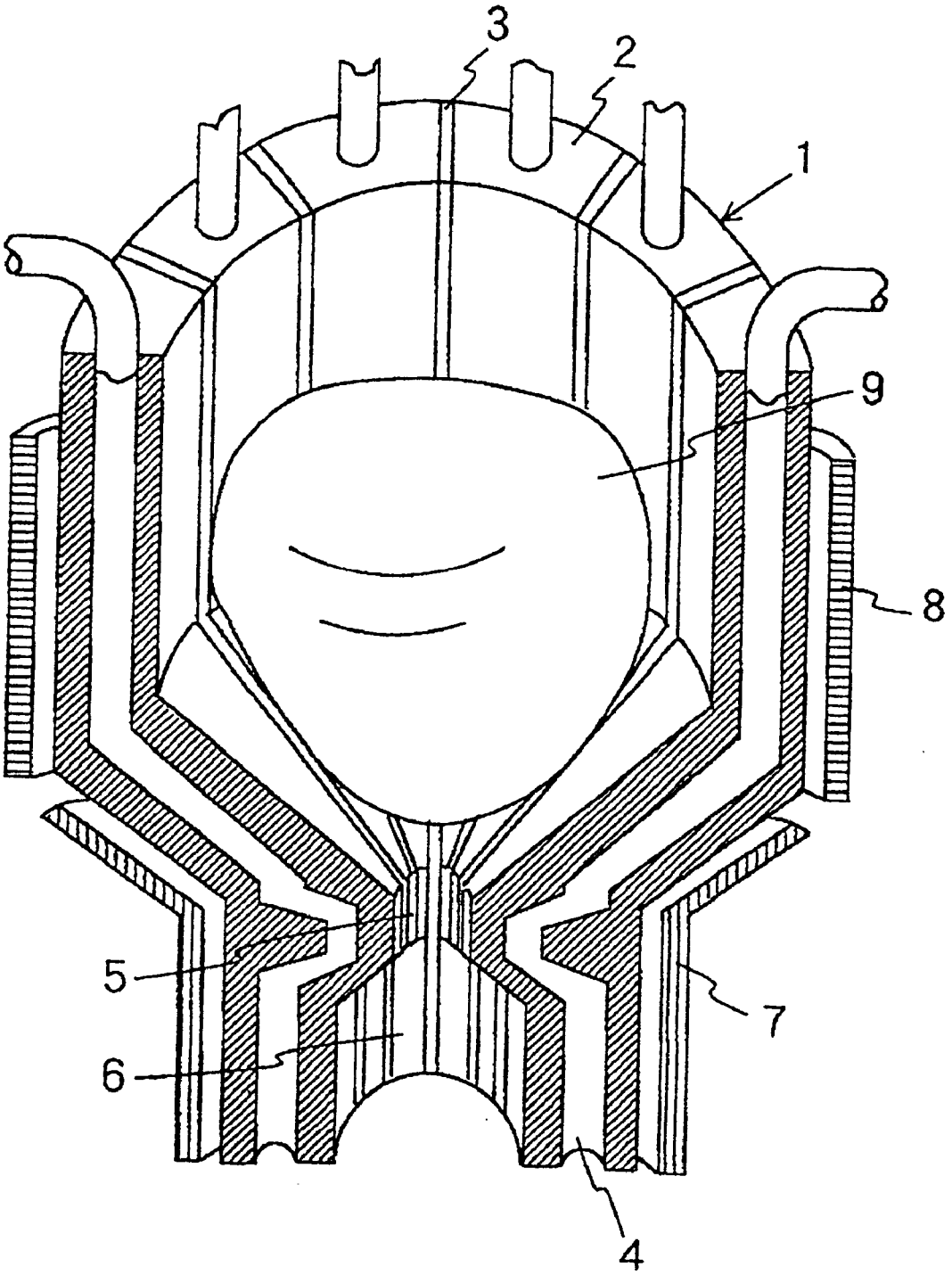
FIG. 3 is a vertical sectional perspective view showing a structure of a floating melting apparatus used in this invention for experimental purposes.

A sample experiment in which a float-melting apparatus was used to manufacture an electrode material is described below. FIG. 3 is a vertical sectional perspective view of the floating melting apparatus used in the experiment. In this figure, a crucible 1 is formed by laminating segments 2, wherein each segment is formed of a conductive material (pure copper) with an insulating material 3 sandwiched between the segments, and each segment is cooled by passing cooling water from a cooling water tank (not shown) through a cooling water passage 4 provided inside the segment. A tapping hole 5 is formed at the bottom of the crucible 1, and a tapping pipe portion 6 is provided under the hole. A lower induction coil 7 and an upper induction coil 8 are disposed outside the crucible 1.

When a material 9 is placed in the crucible 1 and high-frequency currents are supplied to the upper and lower induction coils 7 and 8, an eddy current is generated in the material 9, which is then heated and melted by Joule heat. At the same time, repulsive electromagnetic forces occur between the supplied currents and the eddy current. Furthermore, eddy currents are also generated in the segments 2 and repulsive electromagnetic forces occur between these eddy currents and the eddy current in the material 9. Consequently, the material, i.e. molten metal, 9 is raised from the bottom due to the action based on the lower induction coil 7 while being pushed toward the center of the crucible by the action based on the upper induction coil 8, and is then held floating from the wall surface. By turning off the current to the upper and lower induction coils 7 and 8, the material or molten metal 9 in the crucible 1 is tapped from the tapping hole 5 via the tapping pipe portion 6 due to gravity. The floating melting apparatus is installed in a closed container (not shown) and a protective gas is filled in the closed container.

In the experiment, Cr grains of an average size between 1 and 5 mm in diameter and Cu pieces formed by cutting a round bar of oxygen-free copper with a diameter of 5 mm into roughly 5 mm in length were mixed at a ratio of 3 to 7, respectively, in terms of weight, and the mixture was then placed in the crucible 1, in which it was float-melted in an argon gas atmosphere. After the Cr and Cu materials were melted completely, the power supply to the induction coils 7 and 8 was turned off and the molten metal 9 was poured in a water-cooled copper mold (not shown) located under the tapping pipe portion.

Figure 1:
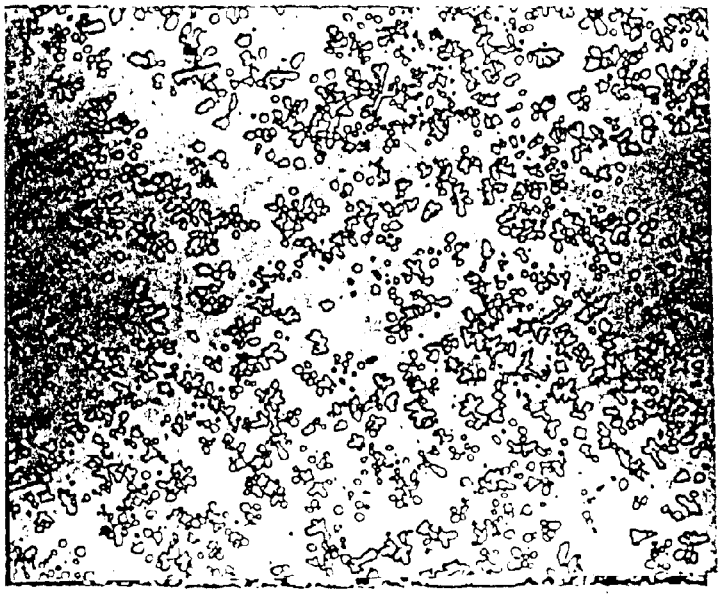
FIG. 1 is a photograph showing the metallographic structure of an electrode material manufactured by using the present method.
Figure 2:
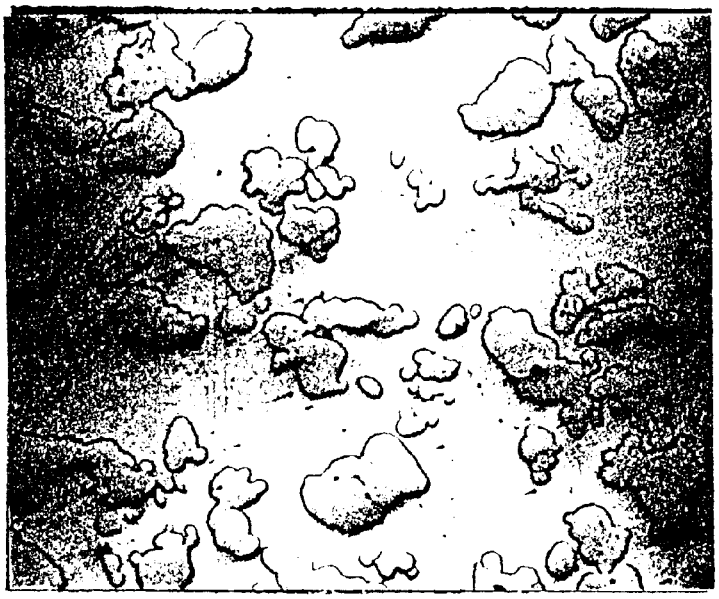
FIG. 2 is a photograph showing the metallographic structure of an electrode material manufactured by using a conventional sintering method.

A photograph in FIG. 1 shows a metallographic structure of a 70% Cu-30% Cr alloy manufactured in this manner. As a comparative example, a photograph in FIG. 2 shows a metallographic structure of a 70% Cu-30% Cr alloy manufactured by using Cr powders of 150 $\mu$m in an average particle size and electromagnetic copper powders of 200 $\mu$m or less in an particle size by the sintering method at 1,000° C. in the heating temperature. The magnification is 70 times in both FIGS. 1 and 2. As is apparent from FIGS. 1 and 2, the Cr particles in this invention (shown as dispersed particles in FIG. 1) are significantly finer (in the example, the particle size is about 20 to 30 $\mu$m) than those in the comparative example (shown as dispersed particles in FIG. 2) and are uniformly dispersed. The amount of oxygen contained in the alloy was measured by using a melted gas analysis method, which determined that it was 900 to 1,100 ppm in the comparative example while it was smaller in this invention, that is, 150 to 250 ppm.

Although, according to this embodiment, the molten metal 9 was casted in the water-cooled copper mold, since the crucible 1 is water-cooled, fine Cr particles can precipitate by turning off the power supply to the upper and lower induction coils 7 and 8 while the tapping hole 5 is occluded in order to cool the molten metal within the crucible 1. In addition, although the floating melting apparatus is ideally used for heating, high-frequency heating can be provided inside an ordinary graphite or ceramic crucible.

According to this invention, Cr is melted into Cu before quenching, and subsequently, Cr precipitates, so that ultrafine Cr particles can disperse as compared to the sintering or melt-infiltrating method and the metallographic structure is prevented from becoming defective due to oxide films on the ingredient powders. In addition, since the size of the precipitated Cr particles is not affected by the particle size of the Cr material prior to melting, the particle size of the Cr material may be increased as long as the melting of this material is not affected in order to reduce the total surface area of the Cr material, thereby minimizing the amount of oxygen contained in the alloy due to the oxide films on the surface of the material.

Furthermore, as this invention can use as a heating source a temperature-controlling heating method such as high-frequency heating, melting can be executed at a temperature suitable for components according to the content of Cu or the adjunction such as Bi or Te, thereby providing an electrode material of industrial stability.

As a result, if the electrode material according to this invention is used for a vacuum circuit breaker, the breaking current and dielectric breakdown voltage can be increased while the chopping current can be reduced to facilitate the manufacture of a small-sized and reliable vacuum circuit breaker.

What is claimed is:

1. A method for manufacturing an electrode material for a vacuum circuit breaker, comprising:

preparing a Cr material having a particle size at least 1 mm to reduce oxygen content therein, and a Cu material, heating a mixture containing the Cu material and the Cr material until the mixture is completely melted in order to obtain a molten metal with both elements melted uniformly, and quenching the molten metal to precipitate Cr particles having a diameter of about 20–30 $\mu$m in a Cu base.

2. A method for manufacturing an electrode material for a vacuum circuit breaker according to claim 1, wherein said heating of the mixture is made by using a floating melting method.

3. A method f or manufacturing an electrode material for a vacuum circuit breaker according to claim 1, wherein said quenching of the molten metal is made by casting in a water-cooled copper mold.

4. A method for manufacturing an electrode material for a vacuum circuit breaker according to claim 1, wherein said electrode material after the molten metal is quenched has an oxygen content of 150–250 ppm.

5. A method for manufacturing an electrode material for a vacuum circuit breaker according to claim 4, wherein said heating of the mixture is made at a temperature so that the Cr material is completely melted in the Cu material, and said quenching is made immediately.

6. A method for manufacturing an electrode material for a vacuum circuit breaker according to claim 4, wherein the Cr material to be melted with the Cu material has an average size between 1 and 5 mm.

7. A method for manufacturing an electrode material for a vacuum circuit breaker according to claim 6, wherein said Cu material is oxygen-free copper with about 5 mm in length.

* * * * *